US006362408B1

(12) United States Patent
Chang

(10) Patent No.: US 6,362,408 B1
(45) Date of Patent: Mar. 26, 2002

(54) LARGE-SIZE DRUM FRAME WITH FIXING LUGS

(76) Inventor: Ming Yi Chang, P.O. Box 2103, Taichung (TW)

( * ) Notice: Subject to any disclaimer, the term of this patent is extended or adjusted under 35 U.S.C. 154(b) by 0 days.

(21) Appl. No.: 09/717,900

(22) Filed: Nov. 22, 2000

(51) Int. Cl.[7] ..... G10D 13/00
(52) U.S. Cl. ..... 84/411 R; 84/421
(58) Field of Search ..... 84/411 R, 421, 84/422.1; D17/22, 99

(56) References Cited

U.S. PATENT DOCUMENTS 4,330,124 A * 5/1982 Vettorello ..... 273/67
5,261,309 A * 11/1993 Valen ..... 84/453
5,337,645 A * 8/1994 Johnston ..... 84/421
5,811,709 A * 9/1998 Adinolfi ..... 84/723

* cited by examiner

*Primary Examiner*—Robert E. Nappi
*Assistant Examiner*—Kim Lockett
(74) *Attorney, Agent, or Firm*—Rosenberg, Klein & Lee

(57) ABSTRACT

A Large-size drum frame with fixing lugs. The drum frame is a substantially annular frame for tensioning the drumhead. The drum frame integrally extends from inner face to top and bottom sides. The top and bottom edges are bent to respectively form hollow lips. A recessed straight waist section is formed between the upper and lower lips. The waist section of the drum frame near the lower lip is punched with a transverse cut line. The waist section on upper edge of the cut line is outward turned to form a plane face on middle portion. The plane face of the lug is formed with a bolt hole for a bolt to pass therethrough to tension the drumhead.

2 Claims, 3 Drawing Sheets

LARGE-SIZE DRUM FRAME WITH FIXING LUGS

BACKGROUND OF THE INVENTION

The present invention relates to a large-size drum frame with fixing lugs. The lugs are formed in such a manner that a waist section of the drum frame is directly punched with a transverse cut line. The waist section on upper edge of the cut line is then outward turned to form a lug. The lug is formed with a bolt hole for a bolt to pass therethrough to tension the drumhead.

FIG. 5 shows a conventional drum frame of a small-size drum. The drum frame 8 is made of a metal sheet by bending. The periphery of bottom face of the drum frame 8 is formed with multiple horizontally bent engaging faces 81 each having a locating hole 82. A fastening bolt 71 is passed through the locating hole 82 and screwed into a fixing seat 72 of the drum body 7 for tensioning the drumhead 73.

Such drum frame 8 is made of one single metal sheet the top edge of which is bent outward and has weak strength. Therefore, this drum frame 8 is only suitable for small-size drum. In case such drum frame is applied to large-size drum, the drum frame is liable to deform and can hardly evenly tension the drumhead 73. As a result, the quality of the drum sound will be affected.

FIG. 6 shows a drum frame of a conventional large-size drum. The drum frame 9 is made of a metal tube by rolling and has higher strength. However, the drum frame 9 itself lacks design for the fastening bolt 93 to pass and lock. A latch hook 91 is used to clamp the top edge of the drum frame 9 and the fastening bolt 93 is passed through the bolt hole of the latch hook 91 and tightened, whereby the drum frame can tension the drumhead 92.

Such drum frame 9 has better strength. However, it must be co-used with the additional latch hook 91. Therefore, the manufacturing cost is higher. Moreover, it is necessary to assemble both the upper and lower drum frames so that the assembling procedure is relatively troublesome. Also, the latch hook 91 is hung on the drum frame 9 and tends to be missed. In addition, the latch hook 91 will affect the appearance of the drum as a whole is affected.

SUMMARY OF THE INVENTION

It is therefore a primary object of the present invention to provide a large-size drum frame with fixing lugs. The drum frame is free from any latch hook so that the manufacturing cost is lowered and the assembling procedure is simplified and the appearance of the drum can be improved.

According to the above object, the large-size drum frame with fixing lugs of the present invention is made of metal sheet by integral bending. A top and a bottom edges of the drum frame are respectively formed with hollow bulge lips with a certain radial thickness. A recessed straight waist section is formed between the upper and lower lips. The waist section is formed with several outward extending lugs at intervals. The lugs are formed in such a manner that the waist section of the drum frame near the lower lip is punched with a transverse cut line. The waist section on upper edge of the cut line is outward turned to form a plane face on middle portion. The plane face of the lug is formed with a bolt hole for a bolt to pass therethrough to tension the drumhead.

The presents invention can be best understood through the following description and accompanying drawings wherein:

DETAILED DESCRIPTION OF THE PREFERRED EMBODIMENT

Figure 1:
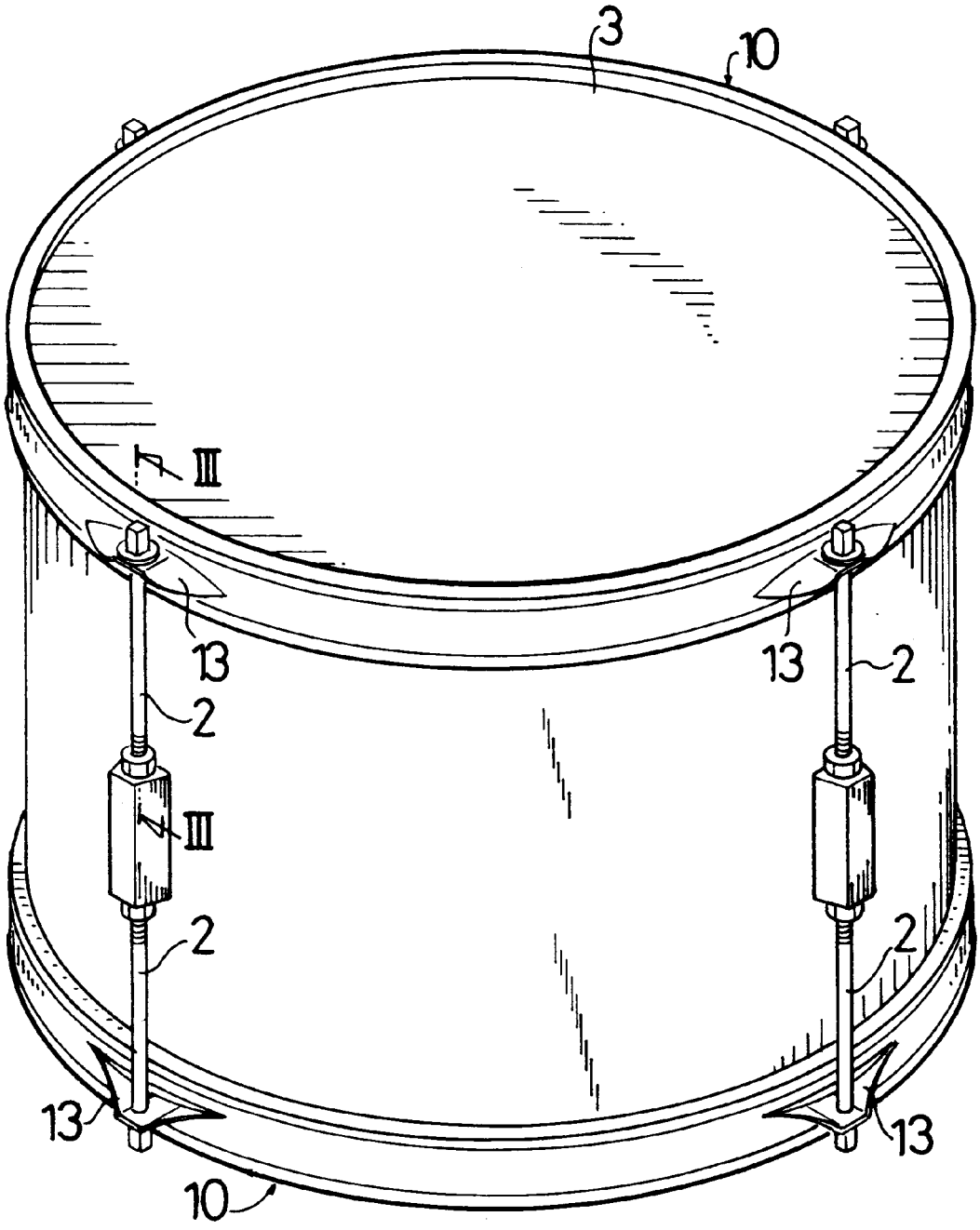
FIG. 1 is a perspective exploded view of the present invention.
Figure 2:
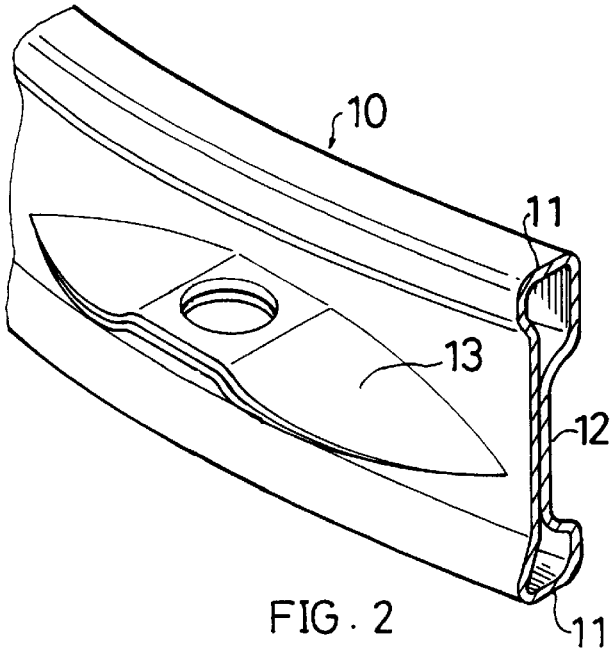
FIG. 2 is an enlarged view of the lug of the present invention.
Figure 3:
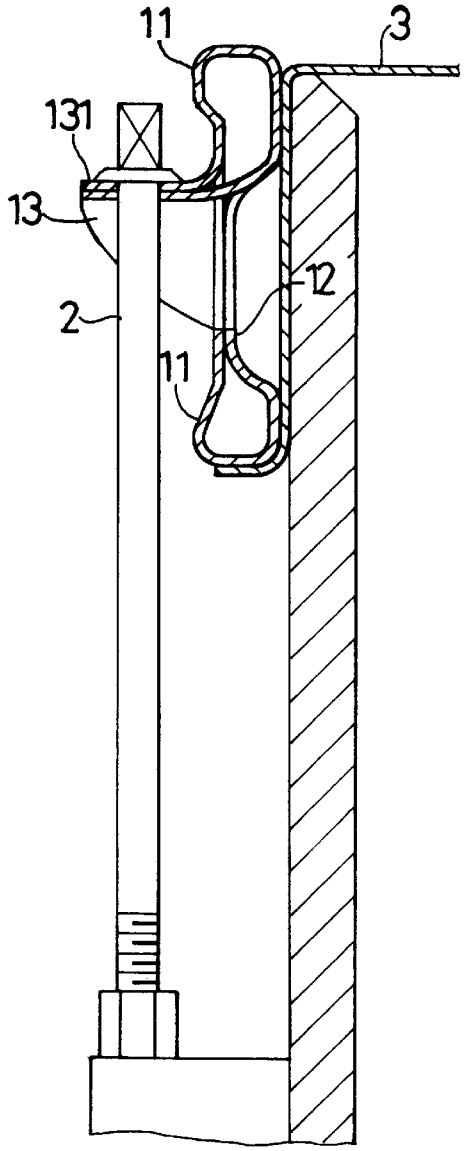
FIG. 3 is a sectional view taken along line III—III of FIG. 1.
Figure 4:
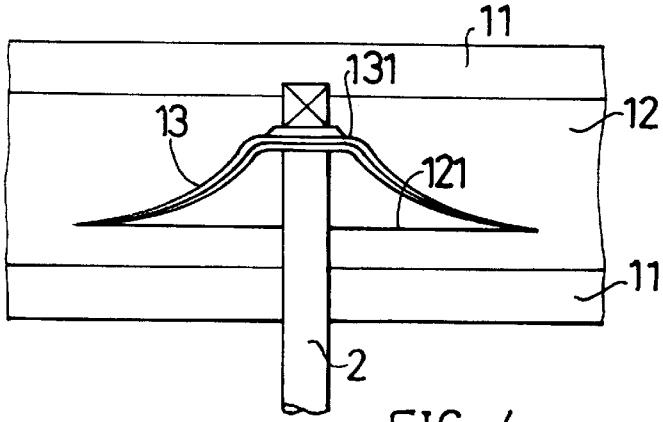
FIG. 4 is a front view showing that a fastening bolt is locked in the lug of the present invention.
Figure 5:
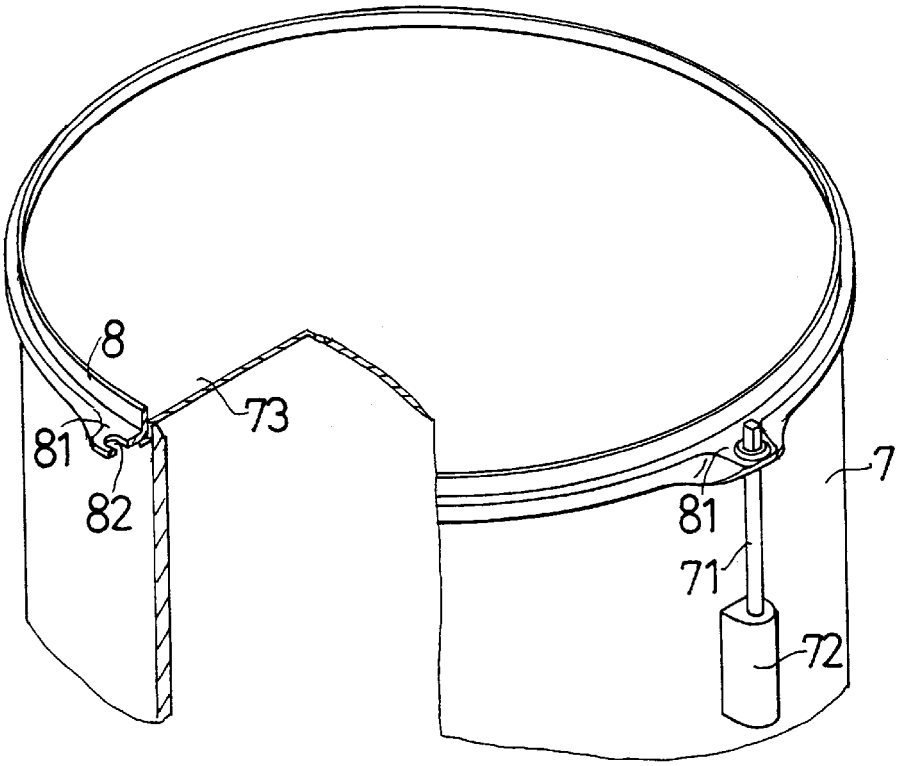
FIG. 5 PRIOR ART
FIG. 5 is a perspective assembled view of a conventional drum frame and the drum body of a small-size drum.
Figure 6:
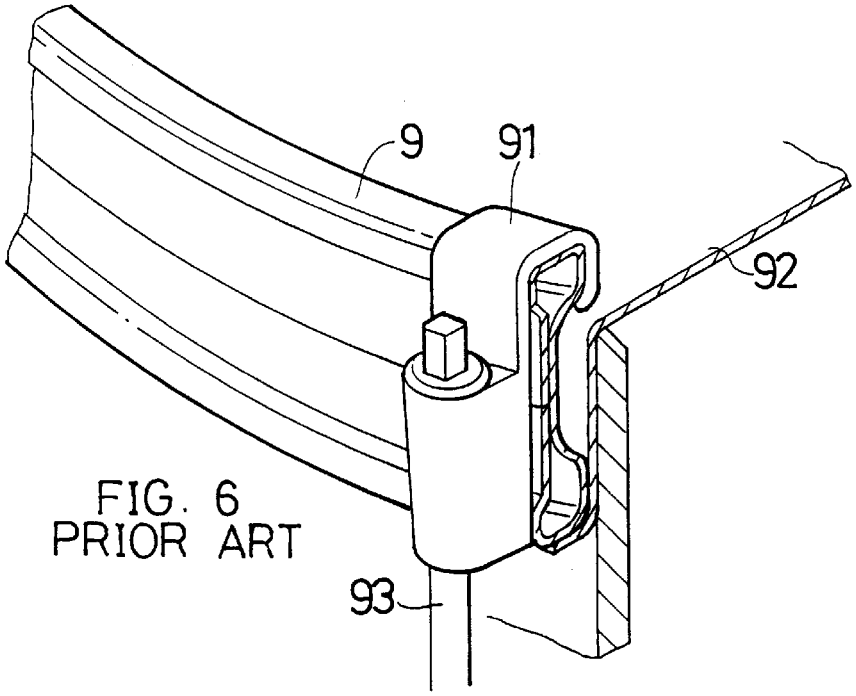
FIG. 6 PRIOR ART
FIG. 6 is a perspective assembled view of a conventional tubular drum frame of a large-size drum.

Please refer to FIGS. 1 to 4. According to a preferred embodiment of the present invention, the drum frame 10 is a substantially annular frame made of metal sheet by integral bending. The drum frame 10 integrally extends from inner face to top and bottom sides. The top and bottom edges are bent to respectively form hollow lips 11 with a certain radial thickness. The lips 11 oppositely extend toward each other and are welded to form a plane face adjacent to the inner face. Accordingly, a recessed straight waist section 12 is formed between the upper and lower lips 11. The waist section 12 is formed with several outward extending lugs 13 at intervals. The lug 13 can be formed by a punching mold. The waist section of the inner face of the drum frame near the lower lip is outward punched along a cut line 121. The waist section on upper edge of the cut line 121 is outward turned to form a plane face 131 on middle portion. Two sides of the plane face are tapered toward two ends of the cut line. The lugs are punched according to a necessary number. The plane face 131 of the lug is formed with a bolt hole 132 for a bolt 2 to pass therethrough to tension the drumhead 3.

The drum frame 10 of the present invention has a hollow reinforcing structure, while being free from any latch hook hung on the drum frame. The waist section 12 is directly integrally outward bent to form the lug 13. Therefore, the problem of miss is eliminated and the appearance is beautified. In addition, the lug 13 is integrally outward bent from the waist section, including two layers of metal sheets so that it has enhanced strength.

The above embodiment is only used to illustrate the present invention, not intended to limit the scope thereof. Many modifications of the above embodiment can be made without departing from the spirit of the present invention.

What is claimed is:

1. A large-size drum fame with fixing lugs comprising an annular frame member integrally formed of sheet metal bent to form a pair of spaced hollow bulge lips with a recessed waist section formed therebetween for engaging a drumhead, said waist section being formed by two layers of said sheet metal and having a plurality of cut lines formed therethrough in angularly spaced relationship, said waist section having a plurality of integrally formed outwardly extending lugs disposed at locations corresponding to said plurality of cut lines, each of said lugs being formed by respective portions of said two layers of sheet metal of said waist section punched from said waist section adjacent a respective cut line, each of said lugs having a planar portion with a through hole formed therein for receiving a bolt used to tension the drumhead.

2. The large-size drum fame with fixing lugs as recited in claim 1, wherein each said lug has a contour that tapers from said planar portion to each of two opposing ends of said cut line.

* * * * *